US006132344A

United States Patent [19]

Vanderbleek

[11] Patent Number: 6,132,344

[45] Date of Patent: Oct. 17, 2000

[54] SYSTEM FOR PROTECTING THE WEIGHTS OF DUMBBELLS THROUGH SLIDE-ON PROTECTOR CAPS

[76] Inventor: James Vanderbleek, c/o 311 Manatee Ave., West Bradenton, Fla. 34205

[21] Appl. No.: 08/926,046

[22] Filed: Sep. 9, 1997

[51] Int. Cl.[7] ..... A63B 21/072

[52] U.S. Cl. ..... 482/108

[58] Field of Search ..... 482/50, 93, 106–108; D21/680–682

[56] References Cited

U.S. PATENT DOCUMENTS

| | | | |
|---|---|---|---|
| 2,447,218 | 8/1948 | Trzesniewski | 482/106 |
| 5,135,455 | 8/1992 | King et al. | 482/108 |
| 5,518,478 | 5/1996 | Liang | 482/108 |

OTHER PUBLICATIONS

Body–Solid. Fitness Equipment & Free Weights Catalog. p. 20 Hexagonal Dumbbells, ©1993.

*Primary Examiner*—John Mulcahy

[57] ABSTRACT

A slide-on protector cap for dumbbells is disclosed. Such protector cap comprises a hexagonal protector member for each weight of a dumbbell. The cap includes six generally rectangular planar plates coupled together in a cylindrical cross-sectional configuration corresponding to the cross-sectional configuration of an associated weight which it is adapted to cover and protect. Each rectangular plate is adapted to be removably slidably positioned over the rectangular planar faces of the associated weight.

1 Claim, 3 Drawing Sheets

SYSTEM FOR PROTECTING THE WEIGHTS OF DUMBBELLS THROUGH SLIDE-ON PROTECTOR CAPS

BACKGROUND OF THE INVENTION

1. Field of the Invention

The present invention relates to a new and improved system for protecting the weights of dumbbells and, more particularly, pertains to protecting dumbbell weights through slide-on protector caps.

2. Description of the Prior Art

The use of dumbbells, weights and protectors of various designs and configurations is known in the prior art. More specifically, dumbbells, weights and protectors of various designs and configurations heretofore devised and utilized for the purpose of protecting dumbbell weights through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of dumbbells, weights and protectors of various designs and configurations. By way of example, U.S. Pat. No. 1,748,406 to Blair discloses a sponge provided with an inside pocket for insertion of a soap cake.

U.S. Pat. No. 3,187,886 to Honey discloses a cushioning carrier for pneumatic tube systems.

U.S. Pat. No. 3,572,574 to Mears discloses a cushioning unit for use inside a packing box.

U.S. Pat. No. 4,988,001 to Brandstetter et al. discloses a multi-unit package for magnetic tapes wound onto cores.

U.S. Pat. No. 5,135,455 to King et al. discloses a user friendly hand held weight.

Lastly, U.S. Pat. No. 5,515,971 to Segrest discloses an apparatus for transporting lamp bulbs.

In this respect, the system for protecting the weights of dumbbells through slide-on protector caps according to the present invention substantially departs from the conventional concepts and designs of the prior art, and in doing so provides an apparatus primarily developed for the purpose of protecting dumbbell weights through slide-on protector caps.

Therefore, it can be appreciated that there exists a continuing need for a new and improved system for protecting the weights of dumbbells through slide-on protector caps. In this regard, the present invention substantially fulfills this need.

SUMMARY OF THE INVENTION

In view of the foregoing disadvantages inherent in the known types of dumbbells, weights and protectors of various designs and configurations now present in the prior art, the present invention provides a new and improved system for protecting the weights of dumbbells through slide-on protector caps. As such, the general purpose of the present invention, which will be described subsequently in greater detail, is to provide a new and improved system for protecting the weights of dumbbells through slide-on protector caps and methods which have all the advantages of the prior art and none of the disadvantages.

To attain this, the present invention essentially comprises a new and improved system of protecting the weights of dumbbells through slide-on protector caps comprising, in combination, a dumbbell having a central shaft in a cylindrical configuration with a pair of weights, one weight on each end of the shaft, each of the weights having a central region in a cylindrical configuration with a hexagonally-shaped cross section forming six rectangular planar faces and with a hexagonally-shaped base and with six tapered trapezoidal sections between the planar faces and the base, the weight having a central axis co-extensive with the axis of the shaft; and a hexagonal protector cap for each weight, each of the caps including six generally rectangular planar plates coupled together in a cylindrical cross-sectional configuration corresponding to the cross-sectional configuration of an associated weight which it is adapted to cover and protect, each rectangular plate adapted to be removably slidably positioned over the rectangular planar faces of the associated weight, each cap also having an open hexagonal end adapted to be positioned over and removed from the associated weight and a closed end formed of a hexagonal end plate on the side of the planar plates opposite from the closed end and with six trapezoidally-shaped plates intermediate the rectangular plates and the end plate for covering and contacting the associated trapezoidal faces of the weight, the cap being fabricated in one piece of a thermoplastic resin of limited flexibility and resilience with a thickness of about 0.1 centimeters.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for protecting the weights of dumbbells through slide-on protector caps which has all the advantages of the prior art dumbbells, weights and protectors of various designs and configurations and none of the disadvantages.

It is another object of the present invention to provide a new and improved system for protecting the weights of dumbbells through slide-on protector caps which may be easily and efficiently manufactured and marketed.

It is a further object of the present invention to provide a new and improved system for protecting the weights of dumbbells through slide-on protector caps which is of a durable and reliable construction.

An even further object of the present invention is to provide a new and improved system for protecting the weights of dumbbells through slide-on protector caps which is susceptible of a low cost of manufacture with regard to both materials and labor, and which accordingly is then susceptible of low prices of sale to the consuming public, thereby making such a system for protecting the weights of dumbbells through slide-on protector caps economically available to the buying public.

Even still another object of the present invention is to protect dumbbell weights through slide-on protector caps.

Lastly, it is an object of the present invention to provide a slide-on protector cap for dumbbells. Such protector cap comprises a hexagonal protector member for each weight of a dumbbell. The cap includes six generally rectangular planar plates coupled together in a cylindrical cross-sectional configuration corresponding to the cross-sectional configuration of an associated weight which it is adapted to cover and protect. Each rectangular plate is adapted to be removably slidably positioned over the rectangular planar faces of the associated weight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
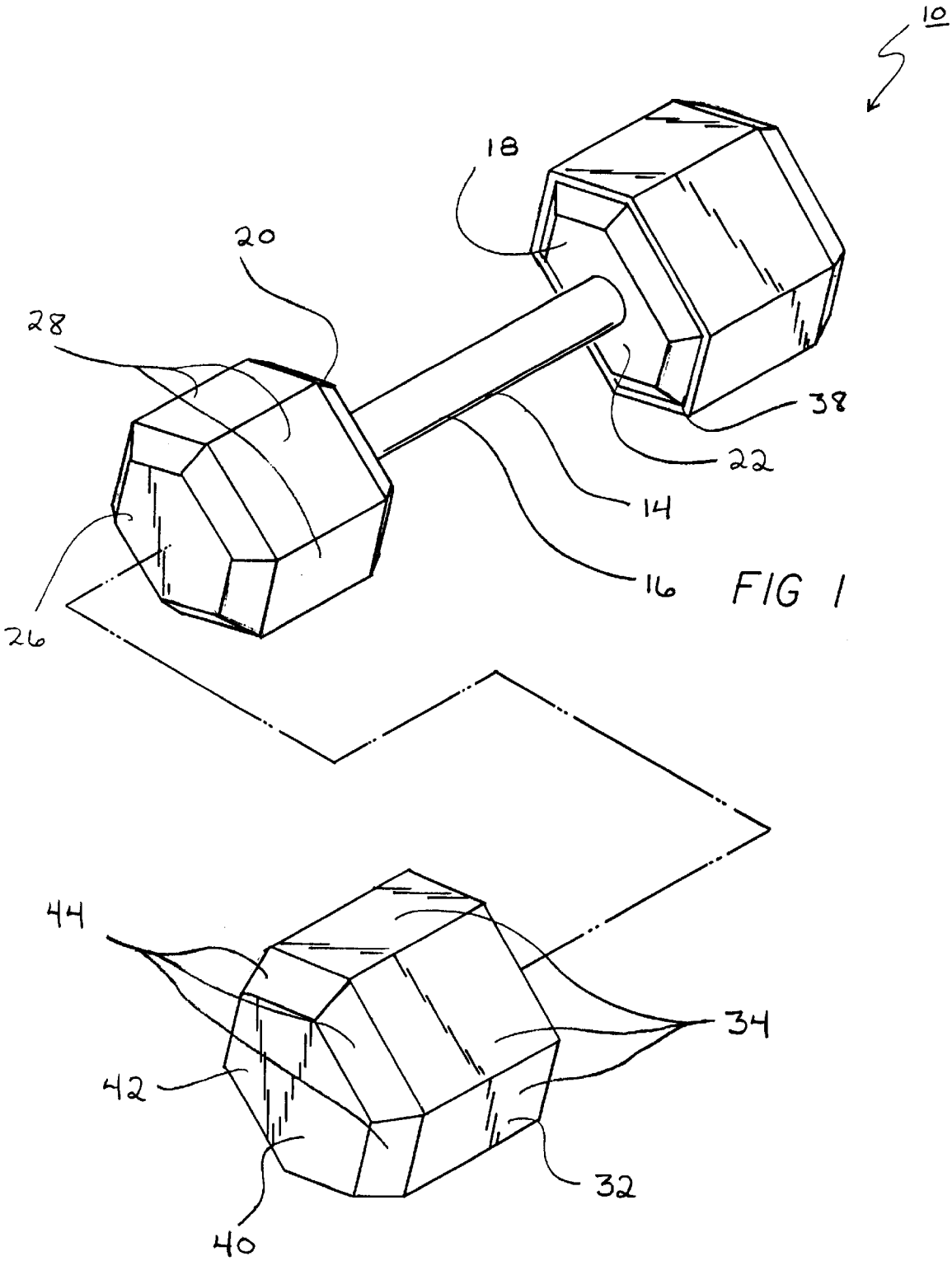
FIG. 1 is a perspective illustration of the preferred embodiment of the new and improved system for protecting the weights of dumbbells through slide-on protector caps constructed in accordance with the principles of the present invention.

With reference now to the drawings, and in particular to FIGS. 1 through 5 thereof, the preferred embodiment of the new and improved system for protecting the weights of dumbbells through slide-on protector caps embodying the principles and concepts of the present invention and generally designated by the reference numeral 10 will be described.

The present invention is a system 10 which is new and improved. Such system is adapted for protecting the weights or enlarged ends of dumbbells through slide-on protector caps of a new, useful and unobvious design and configuration.

The first component of the system 10 is the dumbbell 14. The dumbbell is constructed to have a central shaft 16. The shaft is configured in a cylindrical configuration. It is formed to have a pair of weights 18, 20 integrally formed therewith. One weight is fabricated on each end of the shaft. Each of the weights is formed to have a central region 22 in a cylindrical configuration. Such cylindrical configurations have an axis co-extensive with the axis of the central shaft. Each of the weights is formed with a hexagonally-shaped cross-sectional configuration. There are thus formed six rectangular planar faces 24. In addition, there is formed a hexagonally-shaped base 26 in a plane perpendicular to the axis of the shaft and weight. Six tapered trapezoidal faces 28 are formed between the planar faces and the base. The weights each have a common central axis which is co-extensive with the axis of the shaft.

Next formed as a component of the system is a hexagonal protector cap 32 for each weight. Each of the caps includes six generally rectangular planar plates 34. Such plates are coupled together in a cylindrical cross-sectional configuration. Such configuration corresponds to the cross-sectional configuration of an associated weight which it is adapted to cover and protect.

Each rectangular plate is adapted to be removably positioned through sliding over the rectangular planar faces of its associated weight. Each cap is also formed to have an open hexagonal end 38. The open end is adapted to allow for positioning of the cap over the weight and removed therefrom. Each weight is also formed to have a closed end 40. The closed end is formed of a hexagonal end plate 42 which is located on the side of the planar plates opposite from the closed end. Each protector cap is also formed to have six trapezoidally-shaped plates 44. Such trapezoidally-shaped plates are located intermediate the rectangular plates and the end plate. The trapezoidally-shaped plates are for covering and contacting the associated trapezoidal faces of its associated plate.

Figure 2:
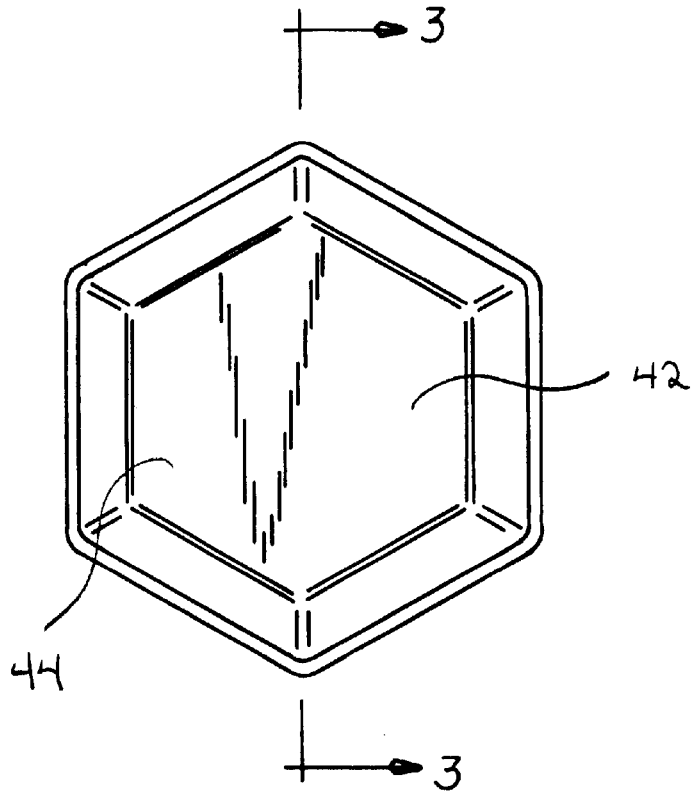
FIG. 2 is an end elevational view of one of the protector caps shown in FIG. 1.
Figure 3:
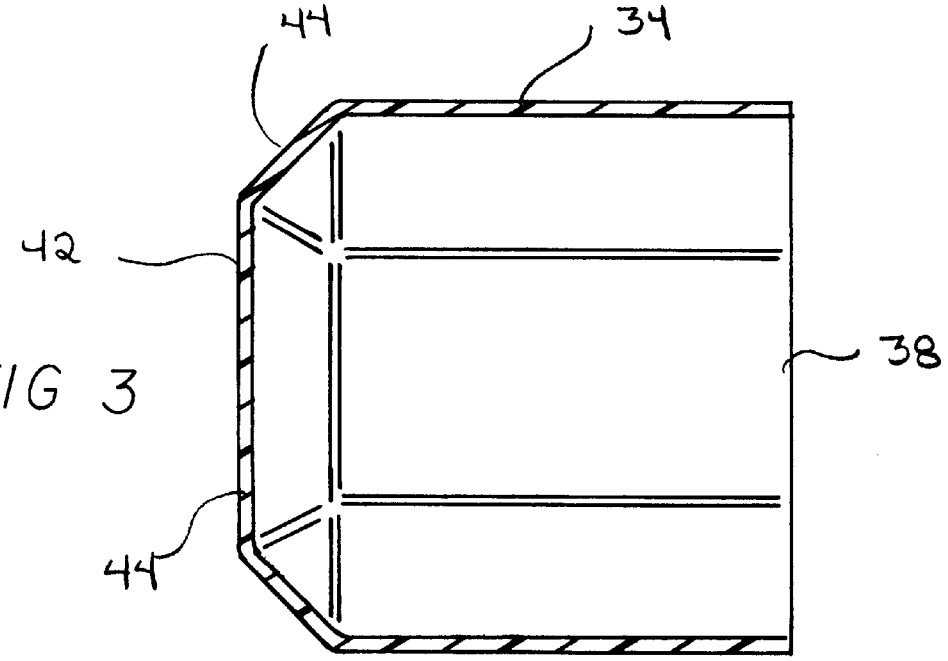
FIG. 3 is a cross-sectional view taken along line 3—3 of FIG. 2.

In the preferred embodiment of the invention as shown in FIGS. 1 through 3, the overall axial length of each cap is about 2 and 3/16 inches. Of this axial length, about 1 and 3/4 inch of the axis is the axial length of each of the six rectangular plates. Each of the plates has a circumferential distance of about 1 and 3/4 of an inch. As such, each of the rectangular plates is essentially square. In addition, the end plate has a largest distance from point to opposite point of about 2 and 7/16 inches. The distance of the end plate from midpoint to midpoint of opposite linear edges is about 2 and 1/8 inches.

The cap is preferably fabricated of a deformable material of limited flexibility and resilience. Thus, the cap is adapted to conform to the shape of the weights when axially slid into position over the weight. Additionally, the cap is adapted to be frictionally retained thereon through its resiliency until axially slid off by a user. When off, the cover will retain its shape as shown.

The cap is preferably fabricated in one piece from a thermoplastic resin such as polyproplyene, vinyl, polyethlyene, or polyurethane. The thermoplastic resin should be of limited flexibility and resilience. The preferred material is polyproplyene. Hard thermosetting resins could also be employed if molded to fit the weights securely. Still other plastics or rubbers could be employed, natural or synthetic, or blends thereof. In an alternative embodiment, materials such as cardboard, or the like, could be utilized. In addition, in the preferred embodiment, the protector cap has a thickness of about 0.1 centimeters with a tolerance of plus or minus 20% throughout its entire extent. The weight of the cap in accordance with the preferred embodiment is about 0.75 ounces. It should be realized, however, that the size and weight of the cap for the preferred embodiment is illustrative only. It should be understood that such caps could be of a proportionately larger or smaller dimension with a corresponding larger or smaller weight as a function of the size of the dumbbell and weights to be covered.

Figure 4:
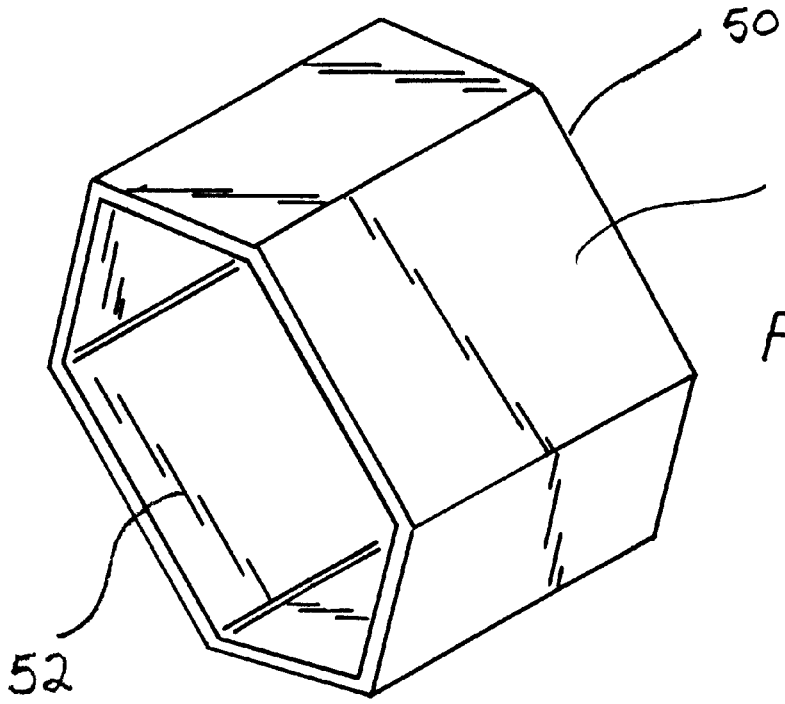
FIG. 4 is a perspective illustration of a protector cap constructed in accordance with an alternate embodiment of the invention.

An alternate embodiment of the present invention is shown in FIG. 4. In such embodiment, the protector cap 48 is formed identically with that disclosed in FIGS. 1 through 3. In the alternate embodiment, the protector cap 48 is formed to have two open ends 50, 52. Such open ends are of a common size whereby either end of the protector may be slid over either weight of a dumbbell. Further, in such embodiment, the trapezoidal faces and face of the weight will remain uncovered.

Figure 5:
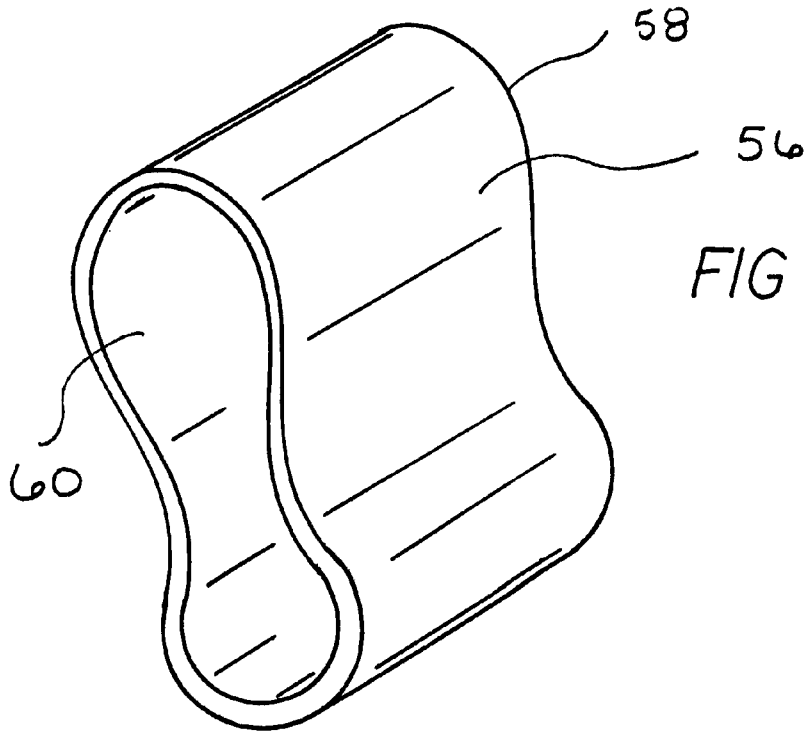
FIG. 5 is a perspective view of a further alternate embodiment of the invention.

A third alternate embodiment of the invention is shown in FIG. 5. In such embodiment, the protector cap 56 is formed as in FIG. 4 with two open ends 58, 60. In such third embodiment, the material is not of a flexible, essentially inextensive polymer such as closed-cell polyurethane foam. Instead, it is formed of a flexible, extensible, generally elastic material such as rubber. The normal relaxed size of the material is such that it will not be able to be slid over the weight of a dumbbell unless it is stretched. When it is stretched, it can be positioned over the rectangular planar faces of the dumbbell and then released whereby the protector cap will resile to conform to the six rectangular planar faces of the dumbbell and protect them from any damage as in the prior embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A system for protecting the weights of dumbbells through slide-on protector caps comprising, in combination:

a dumbbell having a central shaft in a cylindrical configuration and having a central axis and with a pair of weights, one weight on each end of the shaft, each of the weights having a central region in a cylindrical configuration with a hexagonally-shaped cross section forming six rectangular planar faces each being in a plane parallel with the central axis and with a hexagonally-shaped base and with six tapered trapezoidal sections between the planar faces and the base, the weight having a central axis co-extensive with the axis of the shaft; and a hexagonal protector cap for each weight, each of the caps including six generally rectangular planar plates coupled together in a cylindrical cross-sectional configuration of a common size and shape alone the entire axial length and corresponding to the cross-sectional configuration of an associated weight which it is adapted to cover and protect, each rectangular plate being in a plane parallel with the central axis and adapted to be removably positioned over the rectangular planar faces of the associated weight, each cap also having an open hexagonal end of a size and shape the same as that of the perimeter of the central region of an associated weight and adapted to be positioned over and removed from the associated weight by sliding and a closed end formed of a hexagonal end plate on the side of the planar plates opposite from the closed end and with six trapezoidally-shaped plates intermediate the rectangular plates and the end plate for covering and contacting the associated trapezoidal faces of the weight, the cap being fabricated in one piece from a thermoplastic resin of limited flexibility and limited resilience and with a thickness of about 0.1 centimeters.

* * * * *